US005228747A

United States Patent [19]

Greene

[11] Patent Number: 5,228,747

[45] Date of Patent: Jul. 20, 1993

[54] SEATING SYSTEM

[76] Inventor: Kenneth M. Greene, 3744 Bendemeer Rd., Cleveland Heights, Ohio 44118

[21] Appl. No.: 452,109

[22] Filed: Dec. 18, 1989

[51] Int. Cl.[5] ..... A47C 3/00

[52] U.S. Cl. ..... 297/284.3; 297/DIG. 4; 297/284.7

[58] Field of Search ..... 297/284, DIG. 4, 452, 297/458, 459, 460, 384, 284 R, 284 B, 284 C, 284 D, 284 F

[56] References Cited

U.S. PATENT DOCUMENTS

| | | | |
|---|---|---|---|
| 909,411 | 1/1909 | Hockney | 297/DIG. 4 X |
| 1,264,265 | 4/1918 | Brusius | 297/284 |
| 2,102,336 | 12/1937 | Roe | 297/DIG. 4 X |
| 3,640,571 | 2/1972 | Keropian | 297/DIG. 4 X |
| 3,730,589 | 5/1973 | Lane | 297/284 X |
| 3,880,463 | 4/1975 | Shepherd et al. | 297/284 |
| 4,300,249 | 11/1981 | Taylor | 297/460 X |
| 4,362,311 | 12/1982 | Bergman | 297/DIG. 4 X |
| 4,647,066 | 3/1987 | Walton | 297/DIG. 4 X |
| 4,685,693 | 8/1987 | Vadjunec | 297/DIG. 4 X |
| 4,730,842 | 3/1988 | Summers et al. | 297/DIG. 4 X |
| 4,732,423 | 3/1988 | Condon | 297/DIG. 4 X |
| 4,753,482 | 6/1988 | Warren | 297/284 X |
| 4,805,925 | 2/1989 | Haury et al. | 297/DIG. 4 X |
| 4,813,693 | 3/1989 | Lockard et al. | 297/DIG. 4 X |
| 4,819,278 | 4/1989 | Ramos | 297/284 X |
| 4,834,413 | 5/1989 | Patel et al. | 297/DIG. 4 X |
| 4,862,536 | 9/1989 | Pruit | 297/284 X |
| 4,896,917 | 1/1990 | Enevoldson | 297/DIG. 4 X |
| 4,919,487 | 4/1990 | Gibbs | 297/452 X |
| 4,967,864 | 11/1990 | Boyer et al. | 297/DIG. 4 X |

FOREIGN PATENT DOCUMENTS

| | | | |
|---|---|---|---|
| 55712 | 11/1974 | Australia | 297/DIG. 4 |
| 2492657 | 4/1982 | France | 297/DIG. 4 |
| 1595570 | 8/1981 | United Kingdom | 297/DIG. 4 |
| 2194557 | 3/1982 | United Kingdom | 297/DIG. 4 |

OTHER PUBLICATIONS

Safety Travel Chairs, Inc., TranSporter Sep. 4, 1981 entire Document.

*Primary Examiner*—José V. Chen

*Attorney, Agent, or Firm*—Renner, Otto, Boisselle & Sklar

[57] ABSTRACT

A seating system for use with a base such as a conventional, preexisting wheelchair base includes a support unit and mounting bracket assemblies for removably mounting the support unit to the base. The support unit includes a frame assembly and a plurality of cushion elements adjustably connected to the frame assembly. The frame assembly includes a horizontal frame selectively adjustable in width to accommodate wheelchairs of varying widths. The frame assembly also includes a vertical frame, or spine, and an attachment mechanism for removably attaching the spine to the horizontal frame. The spine is adjustable both fore and aft and transversely. The cushion elements each include a connection device for independently and adjustably connecting the cushion elements to the frame assembly. The cushion elements are contourable so that they may be formed and reformed to fit to the specialized needs of each individual using the system.

33 Claims, 7 Drawing Sheets

SEATING SYSTEM

FIELD OF THE INVENTION

The present invention relates to a seating system which may find particular application in a wheelchair, but which may find broader application in seating systems generally.

BACKGROUND OF THE INVENTION

A conventional wheelchair may be considered to include a patient support unit and a wheelchair base. The support unit is formed of the seat bottom and seat back on which the patient's body rests. The wheelchair base includes the wheels, casters, and other structural elements.

Conventional wheelchairs have been designed to accommodate and enhance the mobility of the users. For instance, many wheelchairs are designed so that they can be folded up easily. This allows the user of a wheelchair to travel in a car while storing the wheelchair conveniently in the trunk or in the back seat.

Wheelchairs have been designed to accommodate different size patients. They come in different widths and have different wheel bases depending upon the needs of the patient. In addition, wheelchairs have been provided with accessories to support patients. For example U.S. Keropian Pat. No. 3,640,571 shows a pair of thoracic and lumbar supports to support a patient with scoliosis.

Patients with severe deformities have had seats custom formed to fit their bodies. These cushions have been made by forming a plaster impression of the patient's body and using that impression to make a mold in which a custom foam cushion is subsequently formed. Custom foam cushions made in this way have some disadvantages. They cannot be changed once they are manufactured, so they do not accommodate a patient's growth easily. In addition, they do not easily accommodate changes in patient's size as when winter clothing is necessary. When stretching vinyl over the custom shaped foam, the vinyl may develop weaknesses which wear out prematurely. Moreover, when a wheelchair with a custom seating system is no longer needed, it has often been discarded even though the wheelchair base is still functioning well.

For these reasons a need remains for a seating system which can be installed on previously used wheelchair bases and which can be readily adjusted to accommodate the changing physical needs of a patient or, when no longer needed by one patient, can be adjusted to the different physical needs of another patient.

SUMMARY OF THE INVENTION

The present invention provides a seating system for use in conjunction with a wheelchair base. The seating system comprises a patient support unit and mounting brackets for removably connecting the support unit to the wheelchair base. The patient support unit includes a frame assembly having horizontal and vertical frame members. Transverse telescoping tubes are connected to the horizontal frame member. These tubes can be selectively adjusted so that the seating system can be fit to a wheelchair base of any width. The mounting brackets permit the patient support unit to be adjustably positioned fore and aft and up and down in the wheelchair base.

The vertical frame member, or spine, is removably attached to the horizontal frame. The spine may be adjusted both laterally and fore and aft so that the spine can be positioned at a variety of locations relative to the horizontal frame member.

The seating system includes a plurality if cushion elements connected to the frame assembly. The cushion elements are individually and independently adjustable with respect to the frame assembly. Each cushion element is mounted on a stud which is clamped to one of the frame members. The cushion elements may be pivoted about their studs and the studs may be moved toward or away from the frame assembly.

The cushion elements are contourable so that they may be formed to the shape of the user of the chair. The cushion elements include a polymeric foam surrounding an aluminum core plate. By bending the core plate each cushion element may be shaped to the individual needs of a patient, and they may be rebent to different shapes as the patient's needs change.

To the accomplishment of the foregoing and related ends the invention, then, comprises the features hereinafter fully described and particularly pointed out in the claims. The following description and the annexed drawings set forth in detail certain illustrative embodiments of the invention which are indicative of but a few of the various ways in which the principles of the invention may be employed.

DESCRIPTION OF PREFERRED EMBODIMENTS

Figure 1:
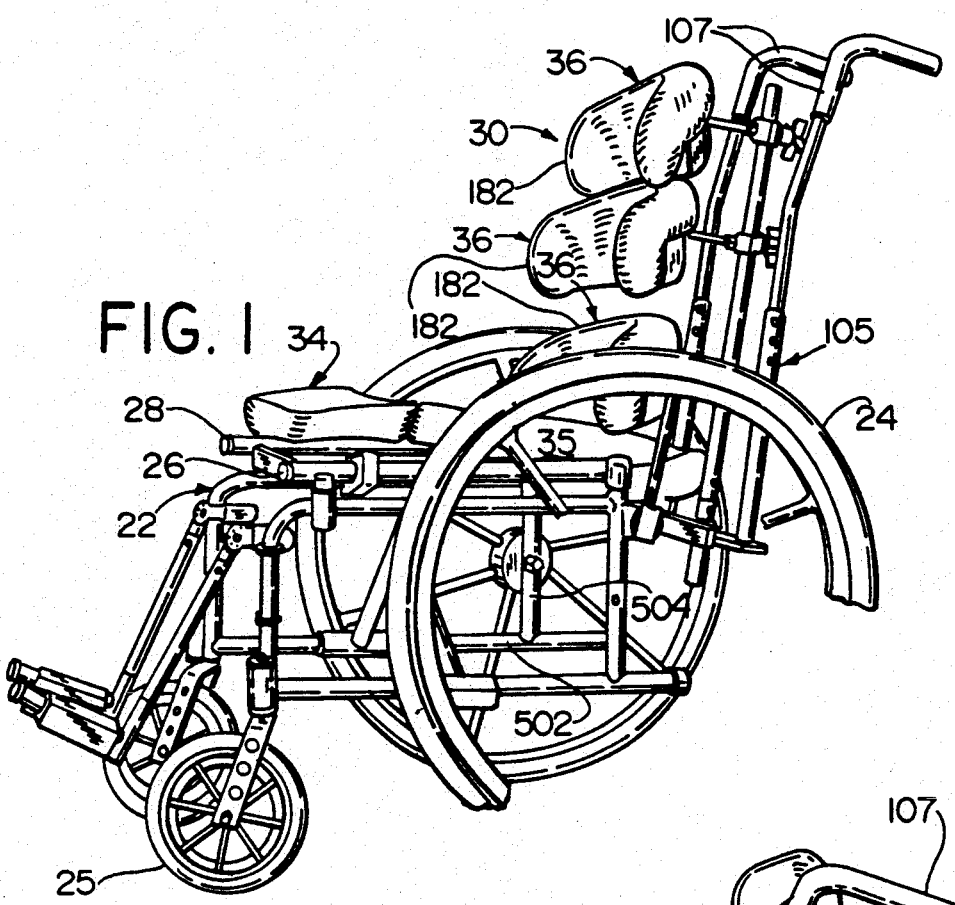
FIG. 1 is a perspective illustration of the seating system of the present invention mounted on a wheelchair base.

Seating system 20 is illustrated in FIG. 1 mounted on a conventional wheelchair base 22. Seating system 20 is compatible with many wheelchair bases such as the wheelchair base 22, and this has many advantages. The seating system 20 permits the reuse of what might otherwise be unused wheelchair bases. Additionally, the seating system 20 is designed to fit a wide range of wheelchair base sizes. The seating system 20 provides the flexibility to accommodate specialized needs of patients which in the past could only be met with customized chairs. The seating system 20 permits nursing homes and hospitals to fill more efficiently and economically the wheelchair needs of their patients.

The conventional wheelchair base 22 includes side wheels 24, casters 25, and horizontal side rails 26 and 28. The seating system 20 includes a patient support unit 30 and various brackets and fittings used to connect the patient support unit to the wheelchair base 22. The brackets and fittings are discussed in more detail below, but for the present purposes it is sufficient to note that they permit the patient support unit 30 to be attached to or removed from the wheelchair base 22 with ease.

Figure 2:
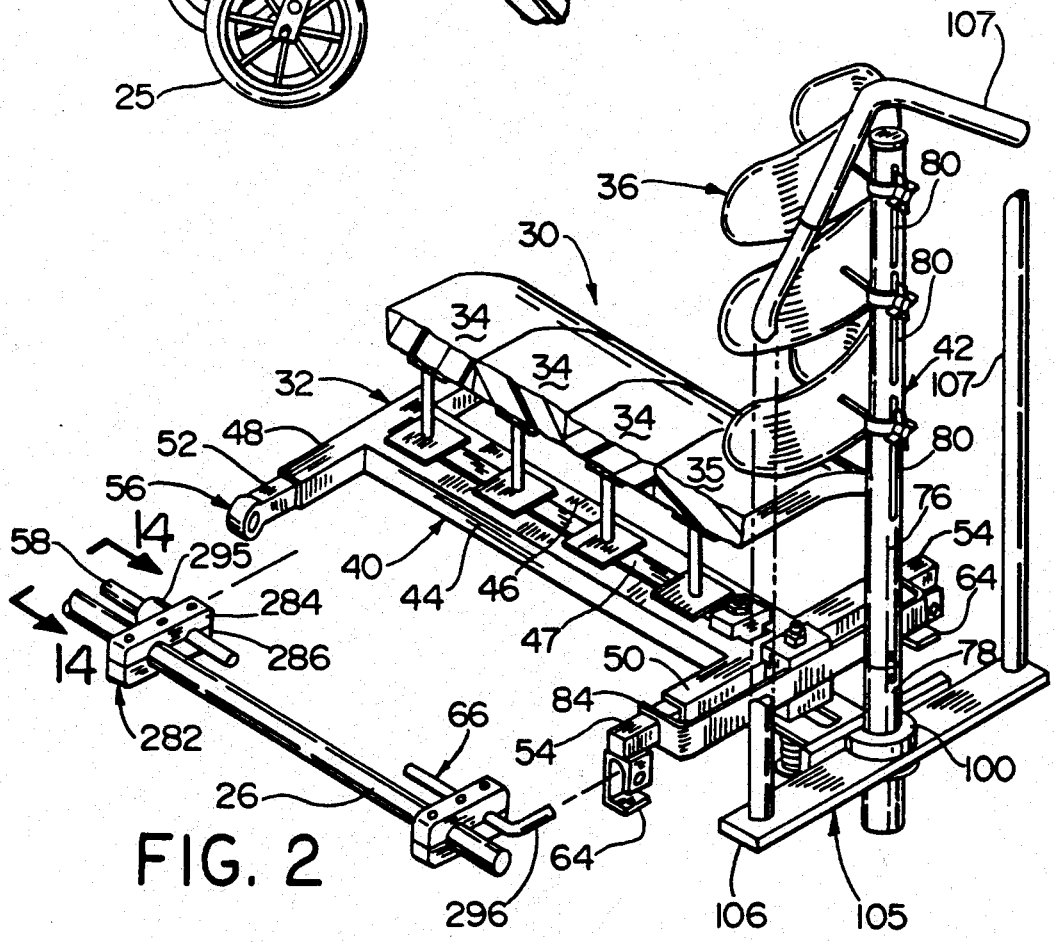
FIG. 2 is a perspective illustration of a patient support unit which forms a part of the seating system, the associated mounting brackets and a portion of the wheelchair base.

The patient support unit 30 is shown in FIG. 2 removed from the wheelchair base 22. The patient support unit 30 includes a frame assembly 32 to which is attached seat bottom cushion elements 34 and spinal support cushion elements 36.

The frame assembly 32 provides the structural skeleton for the patient support unit 30 and contains two major parts, a horizontal seat frame 40 and a vertical frame or spine 42. The horizontal seat frame 40 is formed of a pair of parallel square tubes 44 and 46 (FIG. 3) which extend fore and aft. The tubes 44 and 46 define a narrow slot 47 between them through which the bottom seat cushion elements 34 are mounted.

A pair of tubes 48 and 50 are mounted transversely across the front and back ends of the tubes 44 and 46. Each transverse tube 48 and 50 has a pair of second tubes 52 and 54, respectively, telescoped within. Together the transverse tubes 48 and 50 and the four tubes 52 and 54 form telescoping assemblies which enable the horizontal seat frame 40 to fit into a wheelchair base of any width. Once the tubes 52 and 54 have been adjusted to achieve the desired width, set screws (not shown) are tightened to lock them in place.

A front mounting socket 56 is connected to the distal end of each of the front telescoping elements 52. Front mounting sockets 56 are adapted to receive a cylindrical pin 58 mounted to the wheelchair base 22 (FIGS. 2 and 5) and to be pivotable about the pin through a range of angles. To this end there is a central passage 60 (FIGS. 4 and 5) through each mounting socket 56 formed by oppositely tapering, coaxial conical surfaces 62. The axes of the passages 60 are generally horizontal and parallel to tubes 44 and 46 (FIG. 2) to which the seat cushion assemblies 34 are connected.

Figure 4:
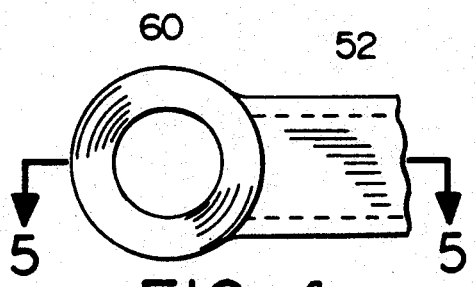
FIG. 4 is a view looking in the direction of arrows 4—4 of FIG. 3.
Figure 6:
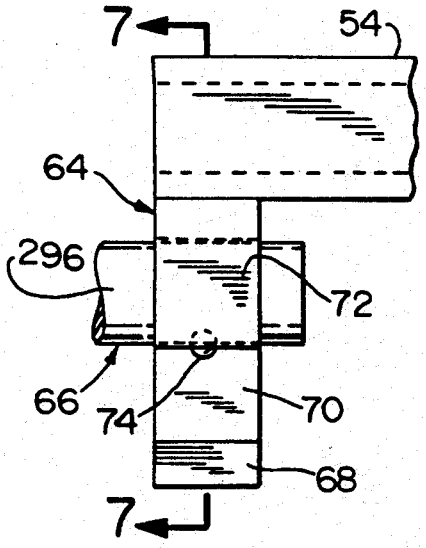
FIG. 6 is a front elevation view of a rear mounting member which forms a part of the frame assembly of FIG. 3.
Figure 7:
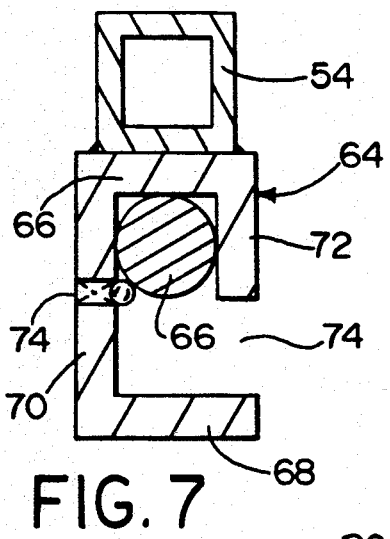
FIG. 7 is a view looking in the direction of arrows 7—7 of FIG. 6.

Rear mounting brackets 64 are attached to the distal ends of the rear telescoping tubes 54 (FIG. 4). These rear mounting brackets 64 are adapted to engage pins 66 (see FIGS. 6, 7 and 2) which extend horizontally from side to side from the wheelchair base 22. As best seen in FIGS. 2 and 7, the rear mounting brackets 64 are generally C-shaped and have a top flange 66, a bottom flange 68, a connecting wall 70 and a capture flange 72 which extends parallel to the wall 70 from the opposite end of the top flange 66. An opening 74 between the top of the flange 68 and the bottom capture flange 72 permits the wheelchair mounted pin 66 (FIG. 2) to fit into the mounting member 64. A spring-loaded detent 74 holds the pin between the capture flange 72, the top flange 66, and the connecting wall 70.

The frame assembly 32 (FIG. 2) also includes a vertical frame or spine 42 which provides support for the patient's back. The spine 42 (FIG. 9) includes an elongated upper tubular member 76 and a lower tubular member 78. The upper tubular member 76 includes three slots 80 (FIG. 2) which extend all the way through the spine 42 for connection of the spinal support cushion elements 36 to the spine. (More or fewer slots 80 can be provided depending on a particular patient's needs). The two tubular members 76 and 78 are joined by an internal pin 81 which is bolted to both members.

Figure 8:
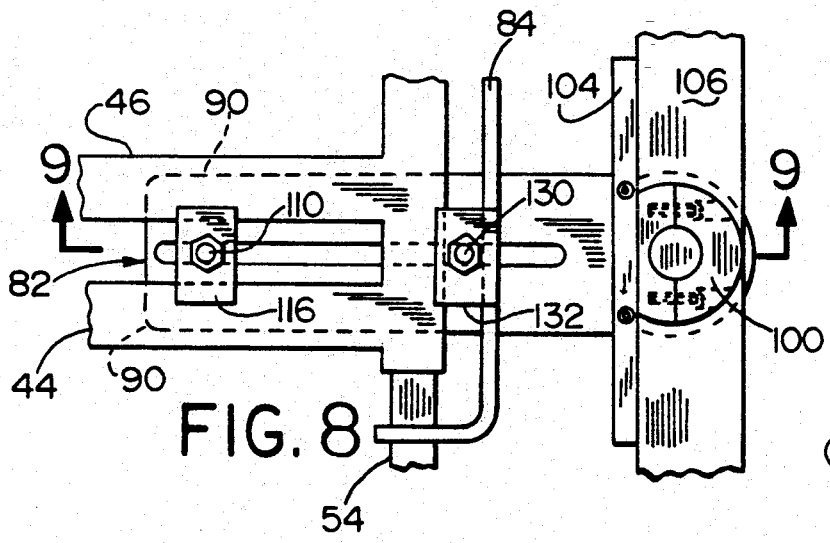
FIG. 8 is a plan view of a vertical frame member and its mounting forming another part of the patient support unit of FIG. 2.

An attachment mechanism 82 (FIGS. 8 and 9) adjustably connects the vertical spine 42 with the horizontal seat frame 40. The attachment mechanism 82 permits the spine 42 to be moved both fore and aft and from side to side so that a wide range of patient needs can be met. The attachment mechanism 82 cooperates with the rear transverse tubes 50 and 54 of the horizontal seat frame 40 and with a transverse track 84 which extends between the tubes 54 across the back of the horizontal seat frame. The transverse track 84 and the back horizontal seat frame tubes 50 and 54 define a slot 86 therebetween.

The track 84 is generally in the shape of a flattened U with each leg connected to one of the telescoping tubes 54. Specifically, each leg has a square opening (not shown) through which the telescoping tubes 54 extend. Set screws (not shown) are provided to lock the track in position.

The attachment mechanism 82 includes a plate 90 (FIGS. 8 and 9) with a socket 92 to receive the spine 42 and a pair of manually adjustable lock bolt assemblies 96 and 98 which connect plate 90 to the horizontal seat frame 40. The forward lock bolt assembly 96 extends through the slot 47 between the horizontal seat frame tubes 44 and 46 and through an alignment slot 94 in the plate 90. The rearward bolt lock assembly 98 also extends through the slot 94 in the plate 90 and through the slot 86 between the track 84 and the rear horizontal seat frame tubes 50 and 54.

When the lock bolt assemblies 96 and 98 are loosened, the slot 94 in plate 90 permits the plate to be moved fore and art. This permits the patient support unit 30 (FIGS. 1 and 2) to accommodate patients with longer or shorter thighs and permits the center of gravity of the seated patient to be moved relative to the axles of the wheelchair base 22. In addition, the lock bolt assembly 98 (FIG. 8) can be moved transversely. This in turn allows the spine 42 to move to the left or right of center. When the lock bolt assemblies 96 and 98 are tightened, the plate 90 is locked in place. This lateral adjustability of the spine 42 together with the individual shapeability of the seat back cushion elements 36 enables the seating system 20 to accommodate patients with scoliosis or other spinal deformities.

The vertical position of the spine 42 can be adjusted by raising or lowering the spine in socket 92. This is accomplished by means of a stop collar 100 (FIG. 9) which is firmly clamped to the lower tubular member 78. The stop collar 100 has a flat 102 milled across one face. This flat cooperates with a stop 104 fastened to the plate 90 to lock the spine 42 against rotation once it is installed in the socket 92. A conventional detent or positive locking mechanism (not shown) may be used to retain the spine 42 in the socket 92.

The patient support unit 30 may also be provided with a handle assembly 105 (FIGS. 1 and 2). The handle assembly 105 includes a transverse bracket 106 to which handles 107 are mounted. The bracket 106 is secured to the collar 10 and rests on the plate 90. The anti-rotation stop 104 transmits torque from the handles 107 through the plate 90 and frame assembly 32 to wheelchair base 22 to steer the wheelchair base.

The handle assembly 105 is not essential since for some patients and some wheelchair bases 22, the handles which came with the original wheelchair may suffice. In such a case the handle assembly is simply omitted.

The forward lock bolt assembly 96 includes a threaded shaft 110 and washers 112 and 114 on opposite sides of the plate 90. When the lock bolt assembly 96 is tightened these washers secure the assembly to the plate 90. The washer 112 is formed of a resilient material, preferably nylon, which can accommodate a slight rocking or pivoting of the plate 90. The lock bolt assembly 96 may be positioned in any desired position in the alignment slot 94 depending on the needs of a patient.

The forward lock bolt assembly 96 also includes an upper clamp washer 116 and a lower clamp washer 118 disposed on opposite sides of the slot 47 between the horizontal seat frame tubes 44 and 46. The upper clamp washer 116 is threaded onto the threaded shaft 110 and held against rotation by a lock nut 120. The lower clamp washer 118 has a clearance hole through it and so is free to move on the shaft 110. Both the upper and lower clamp washers 116 and 118 are partially cut away to fit into the slot 47 between horizontal seat frame tubes 44 and 46 and to be non-rotatable. Because the upper clamp washer 116 is locked onto the shaft 110, it serves to hold the shaft 110 against rotation as the nut 122 at the opposite end of the shaft is tightened.

When the nut 122 is tightened, it bears against flat washer 112 and compresses the entire stack including washer 114, and clamps 116 and 118, locking the plate 90 tightly to the horizontal seat frame 40 and securing it in the desired location.

The rearward lock bolt assembly 98 is generally similar to the forward lock bolt assembly 96. The assembly 98 includes a threaded shaft 130, a pair of metal clamp washers 132 and 134, a nylon compression spring 136 with metal washers 138 and 140 at each end, and manually operable nut 142. The upper clamp washer 132 is threaded onto the shaft 130 and held in place by a lock nut 144, while the lower clamp washer 140 is slidable on the shaft 130. The shaft 130 extends through the slot 86 formed between the transverse track 84 and the rear horizontal seat frame tubes 50 and 54. The upper and lower clamp washers 132 and 134 are contoured to engage the edges of the track 84 and tube 50 so that when the nut 142 is tightened, the clamp assembly 98 is held in place.

The combination of the slot 94 through plate 90, the slot 47 between the horizontal seat frame tubes 44 and 46, and the slot 86 between the rear horizontal seat frame tubes 50 and 54 and the transverse track 55 permits the plate 90 and thus the spine 42 to be moved both fore and aft and side to side to accommodate a wide range of patient needs. In addition, the nylon washer 112 and the nylon spring 136 provide a soft, not rigid, mounting to permit the spine 42 to tilt slightly rearwardly, making the seating system more comfortable than a solid connection.

While the frame assembly 32 (FIG. 1) may be viewed as the structural skeleton of the support unit 30, the cushion elements 34, 35 and 36 provide the surface upon which a patient's body actually rests. The bottom shown in FIG. 2 includes multiple seat bottom cushion elements; as shown there are three identical front seat bottom cushion elements 34 and one back seat bottom cushion element 35, however the number of front seat bottom cushion elements may vary according to patient needs. The seat back of the patient support unit 30 is formed of multiple identical spinal support cushion elements 36, three such elements 36 are shown but more could be used if required for proper patient support. Each cushion element is mounted to the frame assembly 32 in a manner which permits the cushion element to be tipped at almost any angle relative to the frame assembly, and also permits the cushion element to be moved toward or away from the frame assembly.

Figure 10:
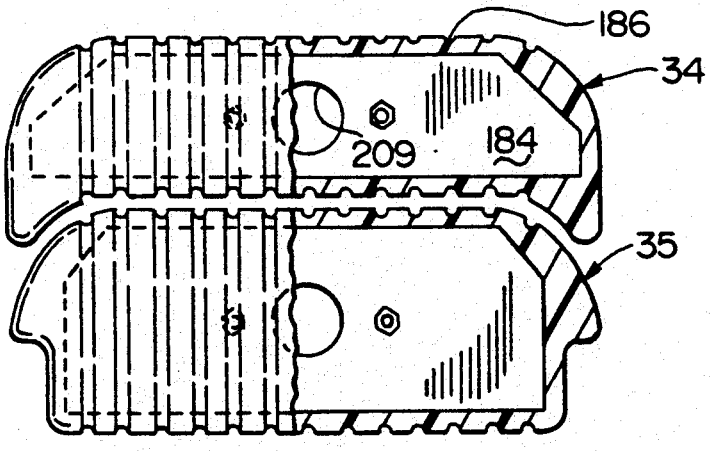
FIG. 10 is a partially cut away top view of two seat cushion elements forming part of the seat bottom of the patient support unit of FIG. 2.

Although their contours vary, all the cushion elements 34, 35 and 36, are essentially alike. Therefore, one of the front seat cushion elements 34 is described in detail with the understanding that the description applies to the other cushion elements 35 and 36. The cushion element 34 includes a core plate 184 (FIG. 10) made of 5052 aluminum sheet 0.100 inch thick. A self-skinning polymeric foam about two inches thick is foamed around the plate 184 to make the cushion 185. In a preferred embodiment the foam is a closed cell foam sold by Uniroyal under the brand name ENSOLITE. It will be recognized by those skilled in the art that other materials could be used so long as the cushion elements provide comfortable support and are able to be shaped to the individual patient. They must be strong enough to hold their shape once formed.

The cushion 185 has a series of grooves 186 which extend in a fore and aft direction on the top surface of the cushion element 34. When the core plate 184 is bent to the shape of a patient, the grooves 186 help the foam to bend without buckling or kinking. Because the cushion 185 is formed of a self-skinning polyurethane foam, the skin is of uniform thickness everywhere. Accordingly, it has no inherent weak spots to wear prematurely the way vinyl vacuum-formed over a foam cushion does.

Figure 11:
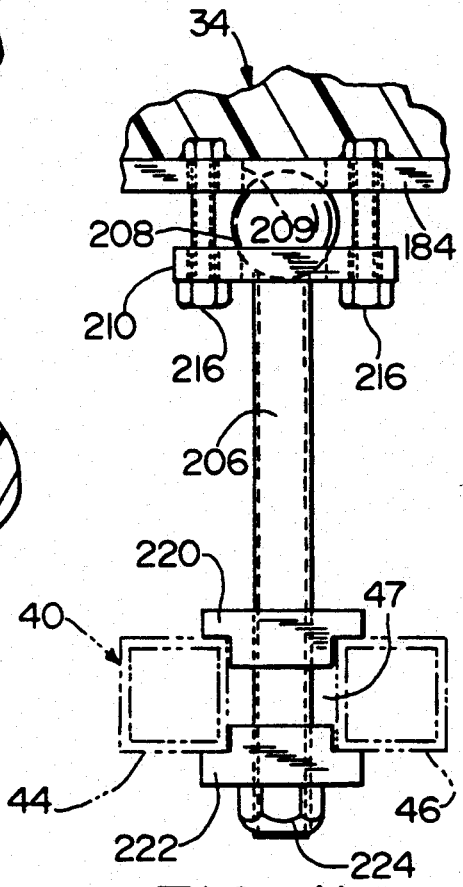
FIG. 11 is a partially cut away front view of a seat cushion and a connector used to connect the seat cushion elements of FIG. 10 to the horizontal frame of FIG. 3.

Core element 184 (FIG. 11) is mounted on a shaft 206 by means of a ball joint 207. Ball 208 is mounted on one end of the shaft 206 and the core plate 184 includes a centrally located circular hole 209 in which the ball 208 rides. A locking plate 210 presses the ball 206 tightly into the hole 209 when bolts 216 are tightened. By loosening the bolts 216, the cushion element 34 can be moved to any desired orientation with respect to the shaft 206.

Figure 3:
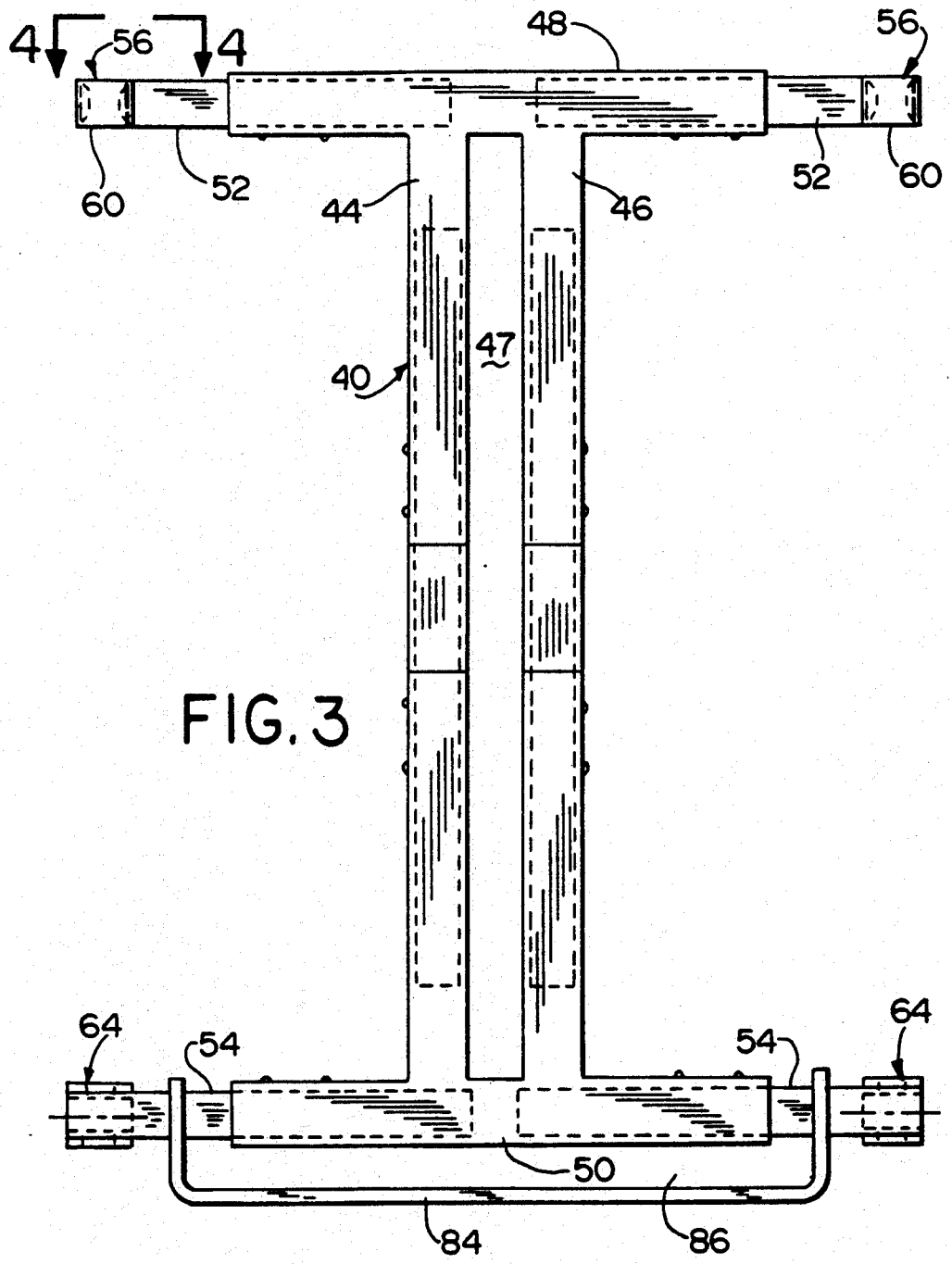
FIG. 3 is a plan view of a horizontal seat frame assembly forming part of the patient support unit of FIG. 2.

The cushion element 34 is also adjustable up and down with respect to the horizontal seat frame 40 (FIG. 3). Specifically, the shaft 206 (FIG. 11) and hence the cushion element 34 is movable toward or away from the horizontal tubes 44 and 46, and it is movable along the slot 47 between them. To this end clamp washers 220 and 222 are mounted on the shaft 206 on opposite sides of the tubes 44 and 46. The washer 220 is threaded while washer 222 is free to turn on the shaft 206. Both are shaped to match the contour of the tubes 44 and 46 to which the cushion element 34 is mounted. A self locking nut 224 serves to squeeze the clamp washers 220 and 222 tight to lock the shaft 206 is position.

Figure 9:
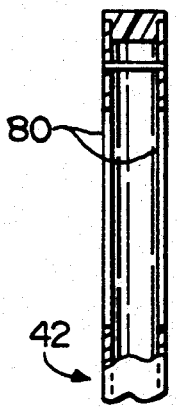
FIG. 9 is a sectional view taken along line 9—9 of FIG. 8.
Figure 9:
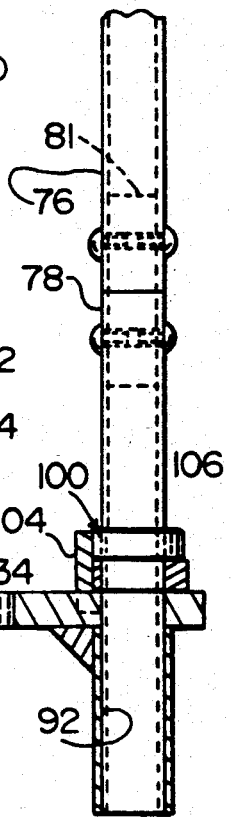
Figure 9:
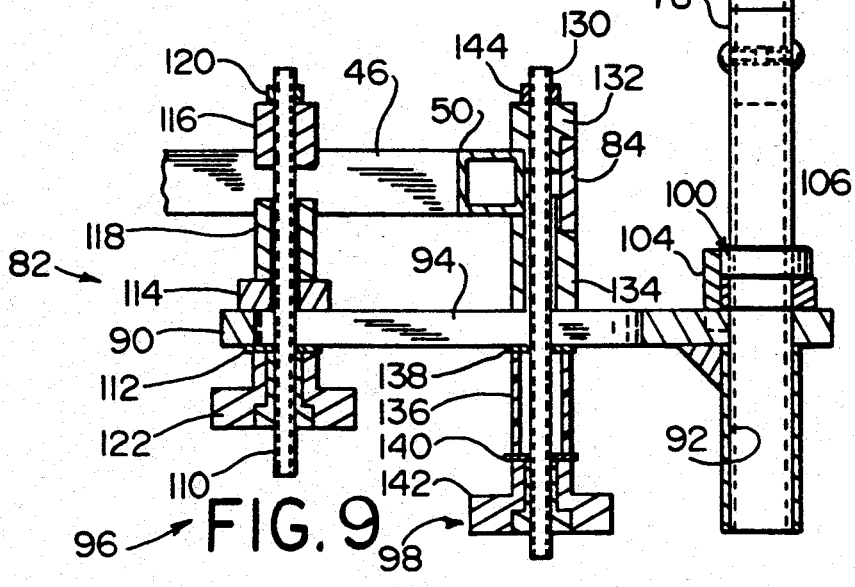

The spinal support cushion elements 36 (FIG. 12) are mounted in essentially the same way except that they are mounted to the spine 42 (FIG. 9). Because the spine 42 is cylindrically shaped, in contrast to the horizontal seat frame assembly which has parallel square tubes 44 and 46, clamp washers 240 and 242 are semicircular rather than the square stepped configuration used to secure the seat bottom cushion element 34 to the horizontal seat frame assembly 40. Clamp washer 240 is threaded while the clamp washer 242 clears the threads on shaft 206. The shaft 206 extends through one of three slots 80 in the spine 42.

Collectively the cushion elements 34, 35 and 36 (FIGS. 1 and 2) make a seat which can be adjusted to accommodate special needs. For example it is relatively easy to prevent a patient from sliding forward off the seat by elevating the forwardmost seat bottom cushion element. The cushion elements can be individually shaped to deformities such as may occur with certain hip surgery or for the treatment of scoliosis. Moreover as a patient's condition changes, the cushion elements may be reshaped to adjust to those changes.

The frame assembly 32 and cushion elements 34–36 provide the patient support unit 30 on which the patient's body rests. The patient support unit 30 (FIG. 1) is mounted to the wheelchair base 22 by a pair of forward bracket assemblies 282 and a pair of rear bracket assemblies 283. One forward bracket assembly 282 and one rear bracket assembly 283 (FIG. 2) are mounted on each of the wheelchair base side rails 26 and 28 (FIG. 1) to engage the front and rear mounting members 56 and 64, respectively (FIG. 2) which are part of the patient support unit 30.

Figure 14:
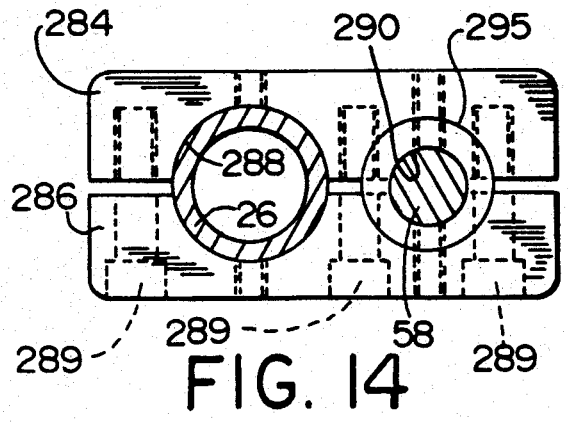
FIG. 14 is a view looking in the direction of arrows 14—14 of FIG. 2.

Each bracket assembly 282 and 283 includes a pair of clamp blocks 284 and 286 (FIG. 14) which are clamped to the wheelchair base side rail 26. The clamp blocks 284 and 286 define a cylindrical passage, or opening, 288 the same or slightly smaller diameter than the side rails 26, 28 on the wheelchair base 22. Because different wheelchair manufacturers use different size railing, clamp blocks with different standard size openings 288 are contemplated. The clamp blocks 284 and 286 may be machined from solid metal or may be stamped.

Each pair of clamp blocks 284, 286 also defines a second passage 290 parallel to the first and which is proportioned to grip a mounting pin 58 or 66. The forward mounting pin 58 (FIG. 2) used at the forward end of the wheelchair base 22 is straight and thus parallel to the wheelchair base side rail 26. The mounting pin 58 fits inside the front mounting sockets 56 on the patient support unit 30 when the patient support unit is mounted on the wheelchair base 22.

The rear mounting pin 66 is the same diameter as the forward mounting pin 58. Thus the clamp blocks 284 and 286 can be used to secure the rear mounting pin 66 to the side rail 26 of the wheelchair base 22. The rear mounting pin 66 (FIGS. 2 and 16) has a 90° bend in it which defines a leg 298 to cooperate with the rear mounting bracket 64 mounted on the patient support unit 30.

The clamp blocks 284 and 286 are held together by bolts 289 which are countersunk into the blocks. Additional set screws (not shown) may be provided to further clamp the blocks 284 and 286 to the wheelchair base rail 26 and to secure the pins 58 and 66.

Figure 5:
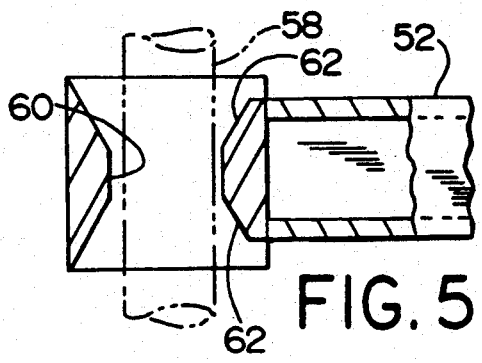
FIG. 5 is a sectional view taken along line 5—5 of FIG. 4.

The forward mounting pin 58 is intended to cooperate with the front mounting socket 56 (FIGS. 1, 2 and 5). A spacer 295 (FIG. 2) is secured to the pin 58 and keeps the front mounting socket 56 from moving too far rearward on the pin 58. Although the pin 58 may extend rearward from the clamp blocks 284 and 286, the active part of this pin is the forward part of it. Conversely it is the rearward, transverse leg 296 of the rear mounting pin 66 which is engaged by the bracket 64.

To install the support unit 30 (FIG. 2) on the wheelchair base 22, first the forward mounting pin 58 and the corresponding pin mounted on the forward portion of side rail 28 are aligned with the passages 60 through the sockets 56. The conical shape of the passages 60 through the sockets 56 (FIG. 5) facilitates getting the pins 292 into the mounting members 56. While this is done, the seat is tipped forward so that the rear mounting brackets 64 (FIG. 2) are above and forward of the rear mounting pins 66.

Next the seat is lowered until the transverse leg 296 of pin 66 is aligned with the opening 74 (FIG. 7) between the capture flange 72 and the bottom flange 68. The support unit 30 is next moved rearward and then down so that the leg 296 of the rear mounting pin 66 is locked in the position shown in FIG. 7. Once the patient support unit 30 is in place, the forward pins 58 cooperating with the sockets 60 prevent side to side motion of the support unit. At the same time the rear mounting pins 66 are received in the brackets 64 and prevent fore and aft movement of the patient support unit 30.

The use of clamp blocks 284 and 286, and the front and rear sockets and brackets 56 and 58, respectively, on telescoping tubes 52 and 54, respectively, facilitates proper positioning of the patient support unit 30 in the wheelchair base 22. The patient support unit 30 can be moved fore and aft both by moving the pins 58 and 66 and by moving the clamp blocks 284 and 286. The entire support unit 30 can be moved up or down by rotating the clamp blocks 284 and 286 around the wheelchair base side rails 26 and 28. This requires a concomitant adjustment of the telescoping tubes 52 and 54 which is easily accomplished by loosening set screws which lock the telescoping tubes in place. Additionally the entire frame assembly could be tilted by lowering the rear mounting pins 66 and raising the forward mounting pins 58.

Figure 15:
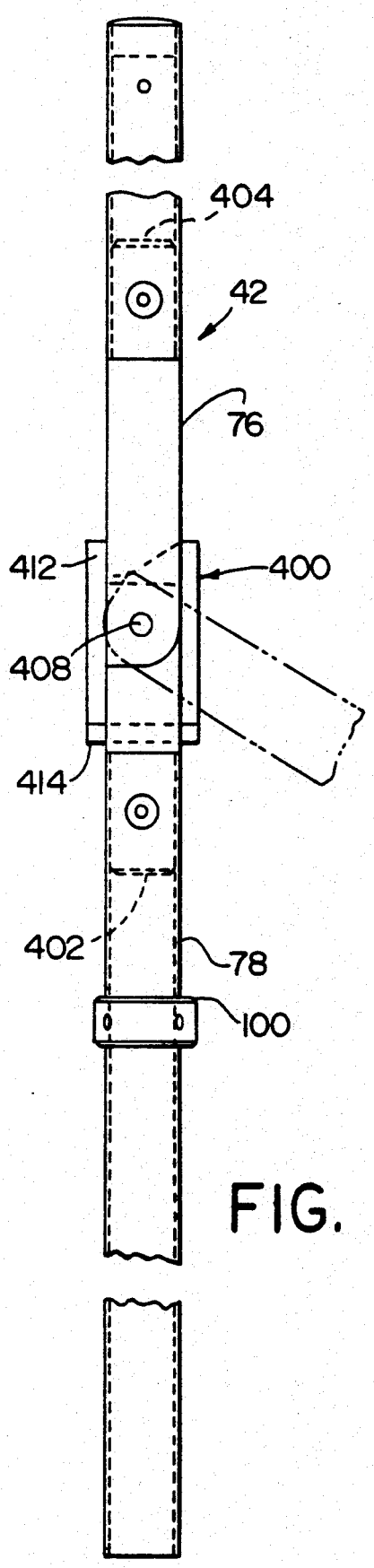
FIG. 15 is a side view of a spine release or foldback mechanism for use with the patient support unit of FIG. 2.

The basic seating system 20 (FIG. 1) described above may include various modifications. For example a spine release mechanism is shown in FIG. 15. This mechanism permits the spine 42 to fold back out of the way. To this end the internal pin 89 has been removed and replaced with a clevis joint 400 which permits the upper tubular member 76 of the spine 42 to move from an upright vertical position to a released position. This may be desirable to allow the wheelchair back to be moved out of the way for transferring patient to a bed or for certain physical therapy activities.

The clevis joint 400 is positioned between the upper tubular member 76 and the lower tubular member 78. The clevis joint 400 includes a pair of solid aluminum members 402 and 404 which extend internally of the tubular members 76 and 78, respectively, where they are bolted in place. Member 402 forms the female half of a clevis joint. It has a slot milled in it and the male half of the joint is machined from member 404 to fit closely within the slot. A roll pin 408 forms a hinge pin. The roll pin 408 passes through aligned passages in the male and female clevis members 402 and 404.

A cylindrical locking collar 412 is free to slide along the members 402 and 404. Downward movement of the locking collar 412 is limited by roll pin 414 which projects outward from the lower, male member 404. When the two clevis members 402 and 404 are in coaxial alignment and the collar 412 surrounds the joint, the clevis members are locked in a coaxial position. Lifting the collar 412 permits the upper spine member 84 to be rotated about the roll pin 408 through approximately 120° as shown in phantom in FIG. 15.

Figure 16:
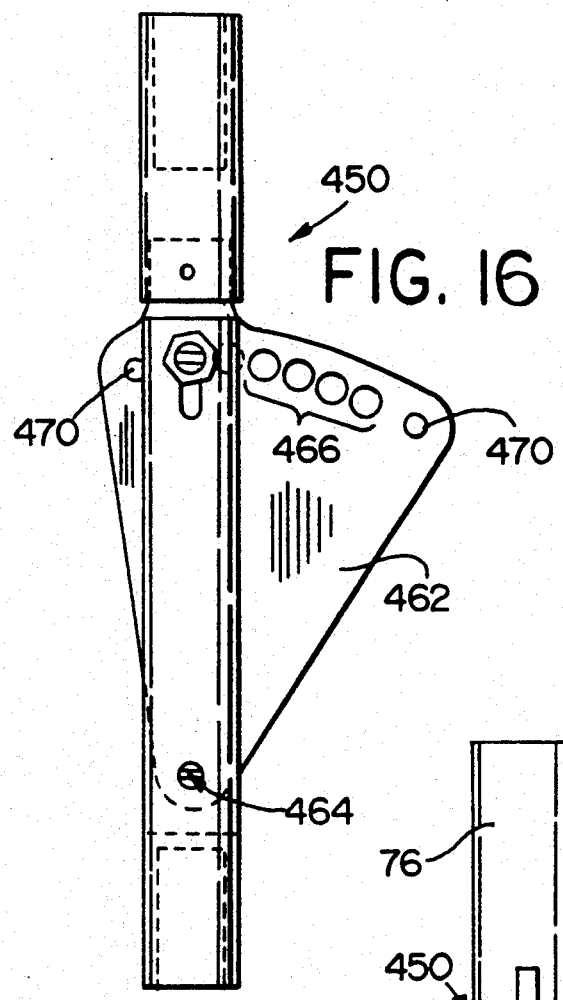
FIG. 16 is a front view of a spine tilt mechanism for use in connection with the patient support unit of FIG. 2.
Figure 17:
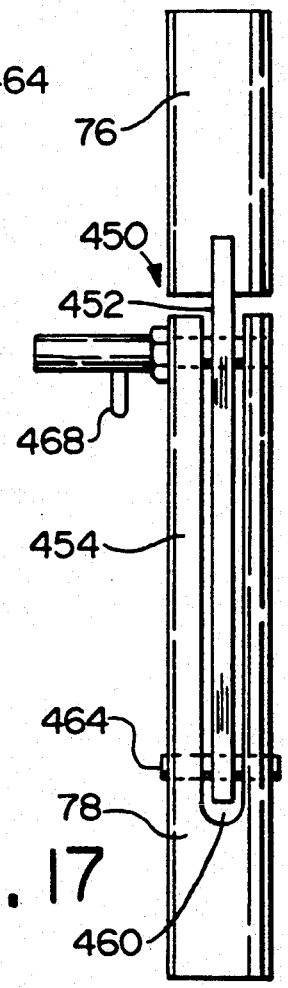
FIG. 17 is a front view of the release mechanism of FIG. 16.

Instead of the clevis mechanism 400, the seating system 20 may include a tilt mechanism 450 shown in FIGS. 16 and 17. The tilt mechanism 450 allows for tilt adjustment of the upper tubular member 76 relative to the lower tubular member 78 in five degree increments. Tilt mechanism 450 is formed of an upper member 452 and a lower member 454 both of which have sockets which receive pins like internal pin 81 (FIG. 9) to secure their connection to the upper spine tube 76 and the lower spine tube 78, respectively. The lower member 454 has a slot 460 which forms the female portion of a clevis type joint. The upper member 452 has a roughly triangular plate 462 at its lower end. A roll pin 464 connects the upper and lower members near the bottom of the slot 460 so that the upper member 452 can rotate about the axis of the roll pin.

The triangular plate 462 includes six holes 466 at five degree increments. A spring loaded pin 468 is mounted at the upper end of the lower, female member 454 and can pass through any one of the holes 466. When the pin 468 is retracted against the spring bias, the upper member can be pivoted to bring any of the holes 466 into alignment with the pin 468 and thus to select a reclined or partially reclined position for the spine 42. Travel is limited by pins 470 which limit the total adjustment to about 30°.

Figure 18:
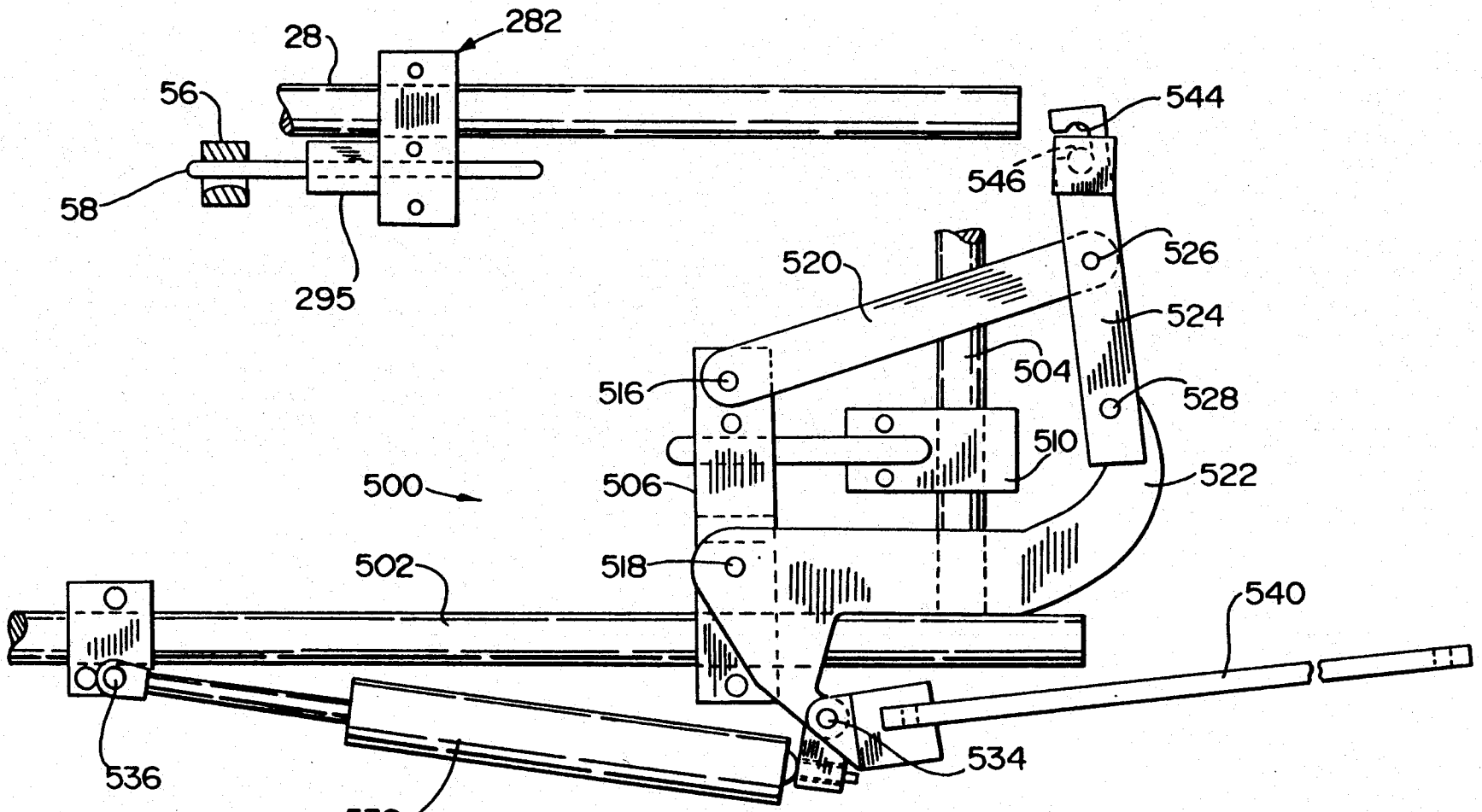
FIG. 18 is a side view of a tilt mechanism which permits the patient support unit of FIG. 2 to be tilted or reclined as a unit.

Another modification of the present invention permits the entire patient support unit 30 to be reclined rearward. This is accomplished by a mechanism illustrated schematically in FIG. 18. The recliner mechanism 500 illustrated in FIG. 18 raises and lowers the rear portion of the horizontal seat frame 40 (FIG. 2) while the front mounting sockets 56 pivot about the mounting pin 58. The recliner mechanism 500 consists of a four bar linkage mounted to the bottom frame tube 502 (FIGS. 1 and 18) and the rear upright frame tube 504 of the wheelchair base 22. The recliner mechanism 500 may be included when the seating system is first purchased or it may be added later when a patient's needs change.

The mechanism 500 includes a base member 506 (FIG. 18) which is secured to the bottom frame tube 502. The base member 506 is stabilized by stabilizer assembly 508 connected to the rear upright frame tube 504 which keeps the base member from rotating around tube 502. By connecting the mechanism 500 to the wheelchair frame in the corner where two tubes forming the wheelchair frame (502 and 504) join, it is possible to make a virtually universal mounting which will work on wheelchair frames of various proportions.

The stabilizer assembly 508 includes a clamp 510 and a rod 512 which extends through and is secured to the base member 506. The base member 506 and stabilizer clamp 510 may be constructed similarly to the clamp members shown in FIG. 14, that is, made of two pieces milled from solid stock material and clamped to opposite sides of the bottom frame tube. Alternatively, the base member 506 and clamp 510 may be formed of stamped steel.

The base member 506 provides pivot mounting points 516 and 518 which support the upper control link 520 and the lower control link 522, respectively. The upper control link 520 has a pivotable connection with a chair support link 524 at 526 while the lower control link 522 is pivotably connected to the chair support link 524 at 528.

A gas cylinder 532 is mounted between a pivot connection 534 with the lower control link 522 and a pivot connection 536 on a mounting block 538 which is rigidly secured to the bottom frame tube 502. A foot pedal release 540 is connected to the gas cylinder 532. When the foot pedal release 540 is pressed downward, the mechanism 500 may change position. As the lower control link 522 rotates clockwise about the pivot mounting point 518, the chair support link 524 moves downward with a slight inward motion of its uppermost end portion. This permits the patient support unit 30 to recline as a unit.

The chair support link 524 includes a pin receiving socket 544 at its uppermost end portion. The socket 544 is essentially similar to the rear mounting member 58 (FIG. 3) in its contour. When the patient support unit 30 is to be provided with the mechanism 500, the telescoping tubes 54 (FIG. 3) of the horizontal seat frame are replaced with telescoping tubes which have a single pin 546 extending axially outward from the end portion of the telescoping member. This pin 546 is received in the pin receiving socket 544 of the chair support link 524. In effect, the roles of the active portion 296 (FIG. 2) of the rear mounting pin 66 and the bracket 64 are reversed when the reclining mechanism 500 is used.

The mechanism 500 is illustrated installed on the right side of the wheelchair base 22 (FIG. 1). There is also provided a similar mechanism (not shown) on the opposite side of the wheelchair so that both rear corners of the horizontal seat frame 40 (FIG. 3) are supported. In addition, the foot pedal release 540 from each of the two mechanisms may be interconnected so that both gas cylinders 532 may be released with a single foot motion. In order to adapt the mechanism 500 to wheelchair bases which can be folded up, the foot pedal release 540 from the left side is connected with a pivotable connection at 550 which is located along the center line of the wheelchair.

Figure 19:
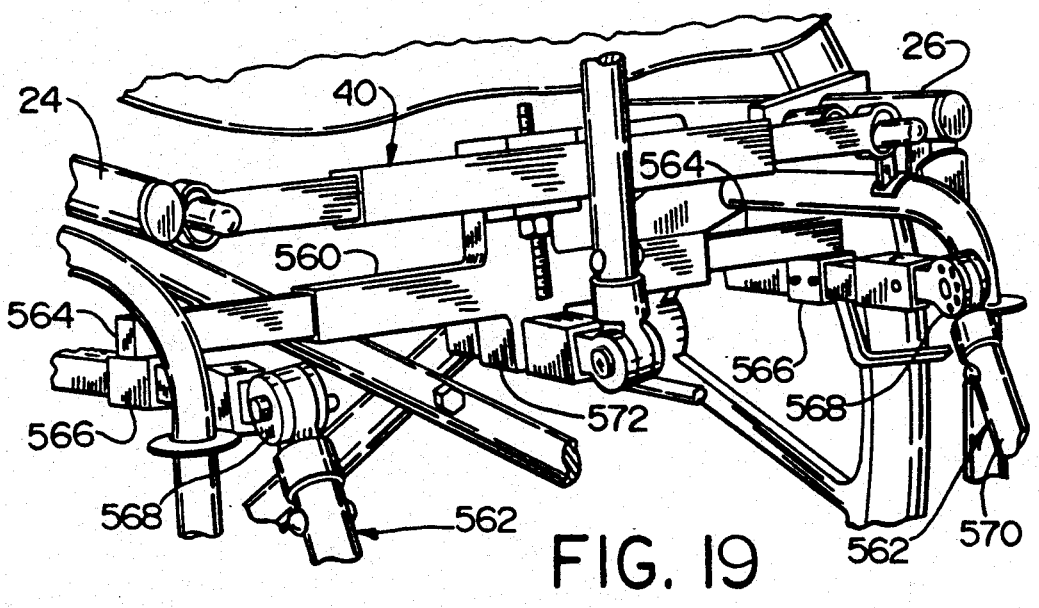
FIG. 19 is a perspective illustration of a footrest assembly which may be attached to the patient support unit of FIG. 2.

The patient support unit 30 may also be provided with a bracket 560 (FIG. 19) which supports foot rests 562 or other accessories. The bracket 560 is bolted to the front of the horizontal seat frame 40 and extends transversely across the width of the wheelchair base 22. The bracket 560 has laterally telescoping arms 564 which each carry an accessory receiving socket 566. The foot rest assemblies 562 may be adjustably positioned in the fore and aft direction by selective positioning in the socket 566 and then tightening set screws which are provided to fix its location. The foot rests 562 are provided with an adjustable knuckle 568 which permits the angle of the foot rest support tube 570 to be adjusted to suit particular patient needs.

An additional centrally located accessory supporting socket 572 is located along the mid line of the bracket 560 and thus directly under the slot 47 (FIG. 3) in the horizontal seat frame 40. The socket 572 is adapted to receive accessories such as an abductor or wedge cushion, conventional accessories for wheelchairs for the handicapped. Because the accessory bracket 560 is mounted to the horizontal seat frame 40, any accessories mounted to the accessory bracket tilt with the patient support unit 30 if a reclining mechanism 500 (FIG. 18) is used.

Figure 12:
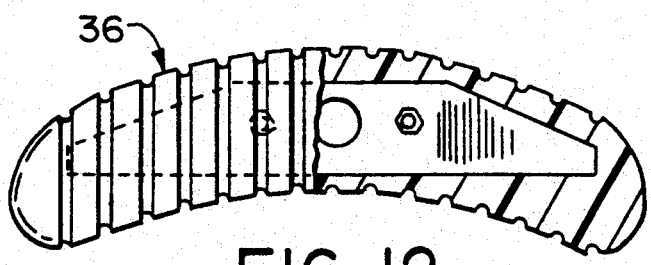
FIG. 12 is a partially cut away front view of a back cushion element forming a part of the patient support unit of FIG. 2.
Figure 13:
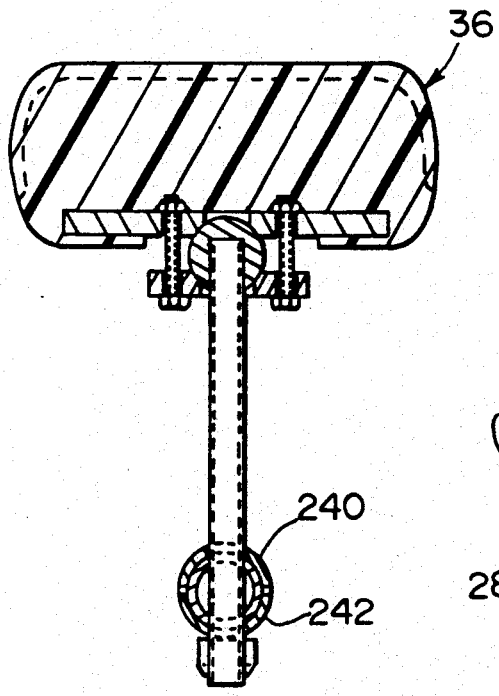
FIG. 13 is a sectional view of the back cushion element forming a part of the patient support unit of FIG. 1 and a connector used to connect the back cushion element to the vertical frame member of FIG. 9.
Figure 20:
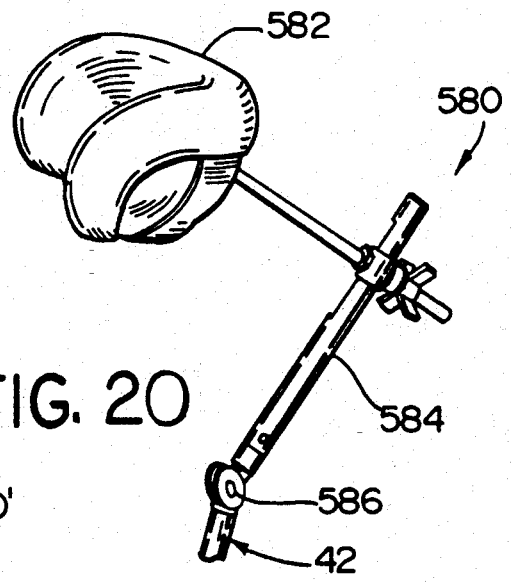
FIG. 20 is a perspective illustration of a headrest assembly which may be attached to the patient support unit of FIG. 2.

An additional accessory which is available is a head rest 580 (FIG. 20). Head rest 580 includes a cushion element 582 which is generally similar to the spinal support cushion element 36 (FIGS. 12, 13). The cushion element 582 is mounted on a spine extension 584. This spine extension 584 is connected by means of an adjustable knuckle joint 586 to the spine 42. The adjustable knuckle joint permits selection of angles between the spine 42 and spine extension 584 according to patient needs.

It should be noted that wheelchairs conventionally provide some sort of arm rest assembly. According to the present invention the arm rests may be mounted to the wheelchair base 22 in an essentially conventional manner. Alternatively, the arm rests may be mounted by suitable brackets to the horizontal seat frame 40. This arrangement has the advantage of permitting the arm rest to tilt with the entire wheelchair base if a mechanism such as the reclining mechanism 500 (FIG. 18) is provided.

Figure 21:
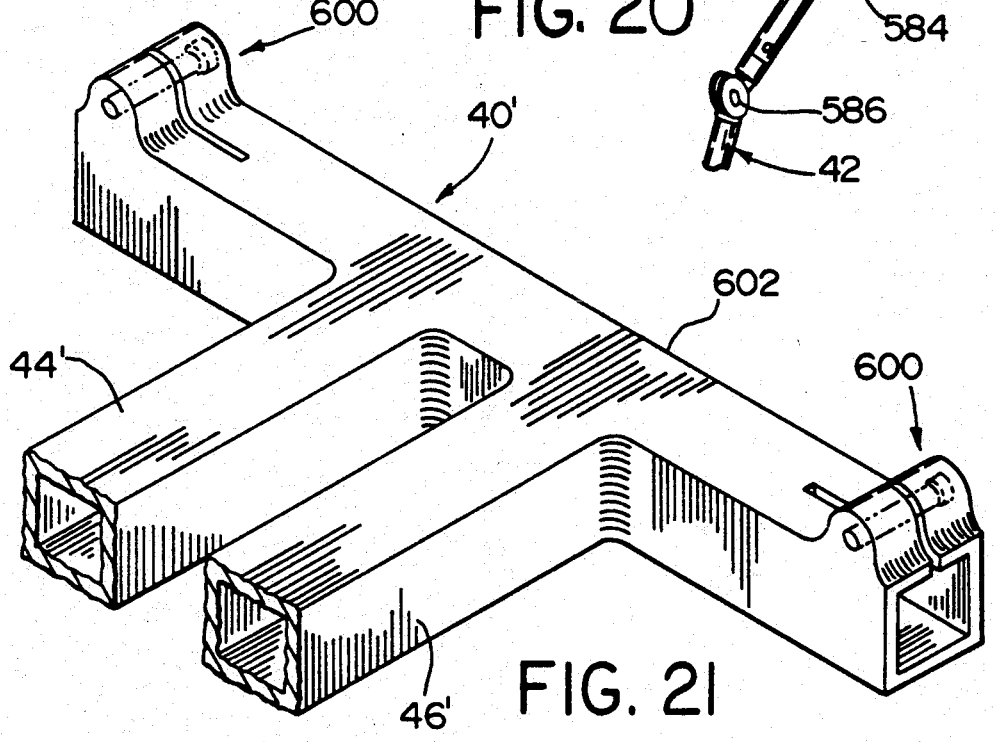
FIG. 21 is a perspective illustration of a portion of an alternative horizontal seat frame.

Additional variations are possible without departing from the scope of the present invention. For example the horizontal seat frame 40 may be made as shown in FIG. 21. In this embodiment the horizontal seat frame 40' is similar to the horizontal seat frame 40 (FIG. 2) except that the telescoping second tubes 52 are held in place not by set screws but by the clamp mechanism 600 built into each end of the transverse square tube 602. Alternatively the entire horizontal seat frame 40, 40' may be fabricated from cylindrical rather than square tubing. In such a case clamp mechanisms similar to those shown at 600 in FIG. 21 would be used. The tubes 44 and 46 could be replaced with a pair of cylindrical tubes or a single centrally located tube could be provided. In the latter case the tube would be provided with slots (like slots 80 (FIG. 2) in the spine 42) to mount the seat cushion elements 34 and 35. A cylindrical tubular horizontal seat frame could also simplify mounting the footrests 562 and abductor 564 (FIG. 19) since the adjustment provided by the knuckle could be provided by a split ring (not shown) mounted on a cylindrical tubular horizontal seat frame member.

Accordingly it is clear that the present invention provides a seating system 20 (FIGS. 1 and 2) for use in conjunction with a wheelchair base 22. The seating system 20 comprises a patient support unit 30 and mounting brackets 58, 66, 282 and 283 for removably connecting the support unit to the wheelchair base 22. The patient support unit 30 includes a frame assembly 32 having horizontal and vertical frame members 42, 48 and 50. Transverse telescoping tubes 52, 54 are connected to the horizontal seat frame members 48 and 50. These tubes can be selectively adjusted so that the seating system 20 can be fit to wheelchair bases of varying widths. The mounting brackets permit the patient support unit to be adjustably positioned fore and aft and up and down in the wheelchair base.

The vertical frame, or spine, 42 is removably attached to the horizontal frame 32. The spine 42 may be adjusted both laterally and fore and aft so that the spine can be positioned at a variety of locations relative to the horizontal frame member 32.

The seating system 20 includes a plurality of cushion elements 34, 35, and 36 connected to the frame members 42, 48 and 50. The cushion elements 34, 35 and 36 are individually and independently adjustable with respect to the frame members. Each cushion element is mounted on a stud 206 (FIG. 11) which is clamped to one of the frame members. The cushion elements 34, 35 and 36 may be pivoted about their studs 206 and the studs may be moved toward or away from the frame assembly.

The cushion elements 34, 35 and 36 are contourable so that they may be formed to the shape of the user of the chair. The cushion elements 34, 35 and 36 include foam 185 (FIG. 10) surrounding an aluminum core plate 184. By bending the core plate 184 each cushion element may be shaped to the individual needs of a patient, and they may be rebent to different shapes as the patient's needs change.

Although the seating system 20 has been described as mounted on a wheelchair base 22, it is evident and anticipated that the support unit 30 could be mounted on other bases and even used outside the medical field for example as part of an office or secretarial chair. It may also be adapted for motor vehicles used by the handicapped, or for those who sit or drive for extended periods of time such as truck drivers.

What is claimed is:

1. A seating assembly comprising a wheelchair conversion system for a previously used wheelchair base and for replacing the seating system of a plurality of previously used wheelchair bases having a multiplicity of differing wheelchair base configurations, said seating assembly comprising:

a support unit; and mounting means for removably mounting said support unit to the previously used wheelchair base; said mounting means including a mounting bracket sized to clamp to a structural element of the wheelchair base, and a mating element attached to said mounting bracket, said support unit including mounting members dimensioned to mate with said mating elements, a frame assembly, and a cushion element connected to said frame assembly;

said frame assembly including a horizontal frame and a means for selectively adjusting the width of said horizontal frame whereby the conversion system may accommodate wheelchair bases of varying widths.

2. A seating assembly as set forth in claim 1 wherein said mounting members dimensioned to mate with said mating elements are attached to said horizontal frame.

3. A seating assembly as set forth in claim 1 wherein said frame assembly further includes a vertical frame; and attachment means for removably attaching said vertical frame to said horizontal frame.

4. A seating assembly as set forth in claim 1 wherein said attachment means includes means for positioning said vertical frame at a variety of locations relative to the horizontal frame.

5. A seating assembly as set forth in claim 4 wherein said support unit includes a plurality of cushion elements; and cushion connection means for independently connecting each of said cushion elements to said frame assembly.

6. A seating assembly as set forth in claim 5 wherein said cushion connection means include angular adjustment means and linear adjustment means for independently adjusting the angle and distance between a cushion element and said frame assembly.

7. A seating assembly as set forth in claim 5 wherein said cushion elements are contourable.

8. A seating assembly as set forth in claim 7 wherein said cushion elements include a polymer foam cushion bonded to an aluminum core plate.

9. A seating assembly as set forth in claim 8 wherein said cushion connection means includes angular adjustment means and linear adjustment means for independently adjusting the angle and distance between a cushion element and said frame assembly.

10. The seating assembly of claim 1 wherein the cushion element includes a relatively stiff core and a flexible cushion surrounding the core, the core being sufficiently malleable to permit forming the cushion to a desired contour and sufficiently stiff to retain the desired contour when sat upon or leaned against by a user of the assembly.

11. The seating assembly of claim 5 wherein the support unit includes cushions which may be manually shaped and reshaped according to the needs of the user of the seating assembly.

12. A seating assembly for a previously used wheelchair base and for replacing the seating system of a plurality of previously used wheelchair bases having a multiplicity of differing wheelchair base configurations, said seating assembly comprising:

a support unit; and mounting means for removably mounting said support unit to the previously used wheelchair base, said mounting means including support unit connecting means for mounting the support unit at a range of angles with respect to the wheelchair base.

13. The seating assembly of claim 12 wherein the mounting means includes means for mounting the support unit at a range of heights with respect to the wheelchair base.

14. The seating assembly of claim 12 wherein the mounting means includes means for mounting the support unit at a range of fore and aft positions with respect to the wheelchair base.

15. A seating system for use with a preexisting, conventional wheelchair base, the seating system comprising:

a support unit; and mounting means for removably mounting said support unit to the preexisting, conventional wheelchair base, said support unit including a horizontal frame having front mounting members dimensioned to mate with said mounting means; said mounting means having a pin extending therefrom, and said front mounting members having a conical interior whereby a pin may be received in said interior at various angles, said horizontal frame including rear mounting members dimensioned to mate with said mounting means; said mounting means having a pin extending therefrom, said rear mounting member including slot means for engaging the pin extending from the mounting means and for limiting fore and aft movement of the support unit with respect to the mounting means when the pin is in the slot means, and wherein the rear mounting member is generally C-shaped having a top flange, a bottom flange, a connecting wall, and a further capture flange extending perpendicularly downward from said top flange, said wall and flanges defining said slot means.

16. A seating assembly as set forth in claim 5 including detent means for retaining said pin in said slot means.

17. A seating assembly for use with a preexisting, conventional wheelchair base, the seating assembly comprising:

a support unit; and mounting means for removably mounting said support unit to the pre-existing, conventional wheelchair base, said mounting means including forward and rear mounting brackets and said support unit including forward and rear engagement means for engaging the forward and rear mounting brackets, respectively, one of said forward and rear mounting brackets limiting movement of the support unit in transverse and vertical directions while permitting movement in a fore and aft direction, the other of the forward and rear mounting brackets limiting movement of the support unit in vertical and fore and aft directions, wherein the forward and rear mounting brackets may be independently raised or lowered to selectively raise, lower or angle the support unit with respect to the pre-existing, conventional wheelchair base.

18. A seating system as set forth in claim 17 including linkage means for raising or lowering one of the forward and rear mounting brackets to recline the support unit with respect to the preexisting, conventional wheelchair base.

19. In combination, a conventional, preexisting wheelchair base and a support unit removably mounted on the wheelchair base, said combination including seat mounting means for removably mounting the support unit to the base, the mounting means including a mounting bracket assembly removably attached to the wheelchair base, the mounting bracket assembly including a mounting bracket and a pin extending therefrom, and the mounting means including a mounting member connected to the support unit and dimensioned to mate with the pin, the support unit comprising a frame assembly and at least one cushion element removably attached to the frame assembly, and wherein the frame assembly includes a horizontal frame and width adjustment means for adjusting the width of the horizontal frame whereby the frame assembly may accommodate conventional, preexisting wheelchair bases of various sizes.

20. The combination as set forth in claim 19 wherein the width adjustment means includes telescoping tubes, and the mounting members are attached to the telescoping tubes.

21. The combination as set forth in claim 19 wherein the frame assembly further includes a vertical frame removably attached to the horizontal frame.

22. The combination as set forth in claim 21 including means for attaching the vertical frame to the horizontal frame and for positioning the vertical frame member at various locations relative to the horizontal frame member.

23. The combination as set forth in claim 22 wherein the support unit includes a plurality of cushion elements and cushion connecting means for independently positioning each of the cushion elements to the frame assembly.

24. The combination as set forth in claim 23 wherein the means for positioning the cushion elements include means for adjusting the angle and distance between each cushion element and the frame assembly.

25. The combination as set forth in claim 24 wherein said cushion elements are contourable whereby the elements may be molded to fit individual needs of a patient.

26. The combination as set forth in claim 25 wherein said cushion elements include aluminum core plates and foam cushions bonded to said core plates.

27. The combination as set forth in claim 19 wherein said horizontal frame includes a front mounting member having a conical interior whereby a pin may be positioned at various angles within said front mounting member.

28. The combination as set forth in claim 27 wherein the vertical frame includes rear mounting member, the rear mounting member being generally C-shaped having a top flange, a bottom flange, a connecting wall, and a further capture flange extending perpendicularly downward from the said top flange.

29. A system for reusing previously used wheelchair bases, said system being for a seated individual and comprising a single apparatus having an adjustable frame including mounting means for mounting the frame in previously used wheelchair bases having differing widths, said mounting means including means for adjustably positioning the frame in a fore and aft direction relative to the base, said frame having a seat bottom portion and a seat back portion, a plurality of cushions each independently secured to the frame, and means for adjustably positioning each of the cushions with respect to the frame, each of the cushions including means for selectively shaping the cushion to the contour of the seated individual, said means for shaping the cushion including means for reshaping the cushion to a different contour including a metal plate and the cushion includes resilient padding material covering the plate wherein said plate is sufficiently malleable to be manually bent to a desired contour and sufficiently stiff to retain the desired contour when sat upon by an individual.

30. A system for reusing previously used wheelchair bases, said system being for a seated individual and comprising a single apparatus having an adjustable frame including mounting means for mounting the frame in previously used wheelchair bases having different widths, said mounting means including means for adjustably positioning the frame in a vertical direction relative to the base, said frame having a seat bottom portion and a seat back portion, a plurality of cushions each independently secured to the frame, and means for adjustably positioning each of the cushions with respect to the frame, each of the cushions including means for selectively shaping the cushion to the contour of the seated individual, said means for shaping the cushion including a metal plate and means for reshaping the cushion to a different contour including a resilient padding material covering the plate wherein said plate is sufficiently malleable to be manually bent to a desired contour and sufficiently stiff to retain the desired contour when sat upon by an individual.

31. A system for reusing previously used wheelchair bases, said system being for a seated individual and comprising a single apparatus having an adjustable frame including mounting means for mounting the frame in previously used wheelchair bases having different widths, said mounting means including means for adjustably positioning the frame angularly relative to the base, said frame having a seat bottom portion and a seat back portion, a plurality of cushions each independently secured to the frame, and means for adjustably positioning each of the cushions with respect to the frame, each of the cushions including means for selectively shaping the cushion to the contour of the seated individual, said means for shaping the cushion including means for reshaping the cushion to a different contour including a metal plate and resilient padding material covering the plate wherein said plate is sufficiently malleable to be manually bent to a desired contour and sufficiently stiff to retain the desired contour when sat upon by an individual.

32. The system of claim 31 wherein the means for adjustably positioning includes front and rear mounting means and linkage means for raising and lowering one of the front and rear mounting means.

33. The system of claim 32 wherein the base is a conventional, preexisting wheelchair base.

* * * * *